US007841743B2

(12) United States Patent
Wang et al.

(10) Patent No.: US 7,841,743 B2
(45) Date of Patent: Nov. 30, 2010

(54) LIGHTING APPARATUS

(75) Inventors: Meng-Hua Wang, Taichung (TW); Hung-Kuang Hsu, Taipei County (TW)

(73) Assignee: Foxsemicon Integrated Technology, Inc., Miao-Li Hsien (TW)

( * ) Notice: Subject to any disclaimer, the term of this patent is extended or adjusted under 35 U.S.C. 154(b) by 178 days.

(21) Appl. No.: 12/074,563

(22) Filed: Mar. 4, 2008

(65) Prior Publication Data

US 2009/0109685 A1 Apr. 30, 2009

(30) Foreign Application Priority Data

Oct. 26, 2007 (TW) ..... 96140360 A

(51) Int. Cl.
*F21S 8/00* (2006.01)

(52) U.S. Cl. ..... 362/268; 362/227; 362/235; 362/249.02; 362/296.01; 362/311.01

(58) Field of Classification Search ..... 362/227, 362/235, 249.01–249.02, 249.06, 249.14, 362/297, 268, 296.01, 311.1–311.02
See application file for complete search history.

(56) References Cited

U.S. PATENT DOCUMENTS 6,547,423 B2 * 4/2003 Marshall et al. ..... 362/333
6,585,395 B2 * 7/2003 Luk ..... 362/249.02
7,270,454 B2 * 9/2007 Amano ..... 362/522

* cited by examiner

*Primary Examiner*—Sandra L O'Shea
*Assistant Examiner*—Meghan K Dunwiddie
(74) *Attorney, Agent, or Firm*—Haynes and Boone, LLP

(57) ABSTRACT

A lighting apparatus includes a reflector, a light source, and a lens unit. The reflector has an open side, and a reflective surface that extends from a periphery of the open side and that defines a compartment. The light source is disposed in the compartment and emits light toward the reflective surface. The reflective surface reflects the light from the light source towards the open side. The lens unit is disposed to close the open side and permits passage of the light reflected by the reflective surface therethrough. The lens unit includes a central lens portion, and first and second side lens portions respectively disposed on two sides of the central lens portion. The central lens portion and the first and second side lens portions are Fresnel lenses, and are configured to redirect the light passing therethrough to result in rectangularly-distributed illumination outwardly of the lighting apparatus.

12 Claims, 6 Drawing Sheets
(1 of 6 Drawing Sheet(s) Filed in Color)

LIGHTING APPARATUS

CROSS-REFERENCE TO RELATED APPLICATION

This application claims priority of Taiwanese Application No. 096140360, filed on Oct. 26, 2007.

BACKGROUND OF THE INVENTION

1. Field of the Invention

This invention relates to a lighting apparatus, more particularly to a lighting apparatus capable of casting rectangularly-distributed illumination.

2. Description of the Related Art

A conventional lighting device on a street, such as a street lamp, usually casts circularly-distributed or elliptically-distributed illumination. When two street lamps are disposed in close proximity, regions of illumination thereof overlap, wherein the overlapping regions are overly bright when the extent of overlap is too large and are dim when the extent of overlap is too small. For vehicles that do not travel at high speeds, such differences in the intensity of illumination do not pose any considerable risk to drivers of the vehicles. However, when vehicles travel at high speeds on an Expressway, such differences in the intensity of illumination often pose unsafe driving conditions. Therefore, it has been proposed heretofore for the street lamps to project rectangularly-distributed illumination in order to improve road safety.

As illustrated in FIGS. 1 and 2, a conventional lighting device 1 that provides rectangularly-distributed illumination includes a reflective body 11, a light source 12, and a lens unit 13. The reflective body 11 is shaped in the form of a hollow four-sided diverging body, and has a rectangular opening 111, and four reflective surfaces 113 respectively extending from the four sides of the opening 111 and cooperating with each other to define a compartment 112. The light source 12 is disposed in the compartment 112 and is positioned centrally in the reflective body 11. A portion of the light emitted by the light source 12 is directed towards the opening 111. Another portion of the light emitted by the light source 12 is reflected by the reflective surfaces 113 so as to travel towards the opening 111.

With further reference to FIGS. 3 and 4, the lens unit 13 is disposed to close the opening 111 and permits passage of the light generated by the light source 12 therethrough. The lens unit 13 is a Fresnel lens that has a plurality of concentric annular triangular structures 131.

Although the lighting apparatus 1 is capable of providing rectangularly-distributed illumination, the rectangular distribution is achieved primarily through reflection of the light by the reflective surfaces 113. It is noted that a large portion of light energy is exhausted during the process of reflection, i.e., before the light exits the reflective body 11. In order to make up for the loss of the light energy and in order to comply with the standard illumination requirement, an increase of the power consumption by the light source 12 is needed, which is not economical.

SUMMARY OF THE INVENTION

It is an object of the present invention to provide a lighting apparatus that can overcome the above drawbacks of the prior art.

According to the present invention, a lighting apparatus includes a reflector, a light source, and a lens unit. The reflector has an open side that defines an axis of symmetry, and a reflective surface that extends from a periphery of the open side and that defines a compartment. The light source is disposed in the compartment and is operable to emit light toward the reflective surface. The reflective surface reflects the light from the light source towards the open side. The lens unit is disposed to close the open side and permits passage of the light reflected by the reflective surface therethrough. The lens unit includes a central lens portion, and first and second side lens portions respectively disposed on two sides of the central lens portion that are on opposite sides of the axis of symmetry The central lens portion and the first and second side lens portions are Fresnel lenses, and are configured to redirect the light passing therethrough to result in rectangularly-distributed illumination outwardly of the lighting apparatus.

BRIEF DESCRIPTION OF THE DRAWINGS

The patent or application file contains at least one drawing executed in color. Copies of this patent or patent application publication with color drawings will be provided by the U.S. Patent and Trademark Office upon request and payment of the necessary fee.

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
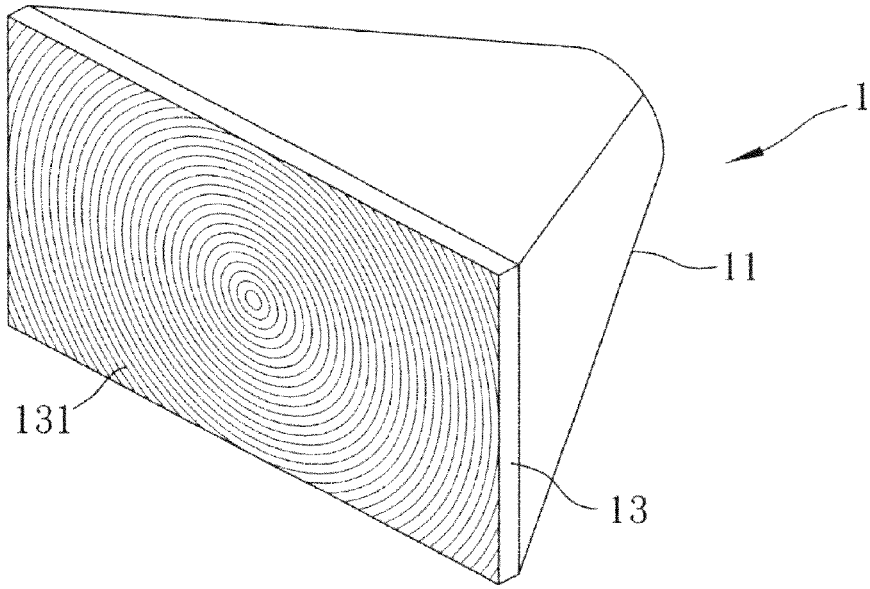
FIG. 1 PRIOR ART
FIG. 1 is a perspective view of a conventional lighting device.
Figure 2:
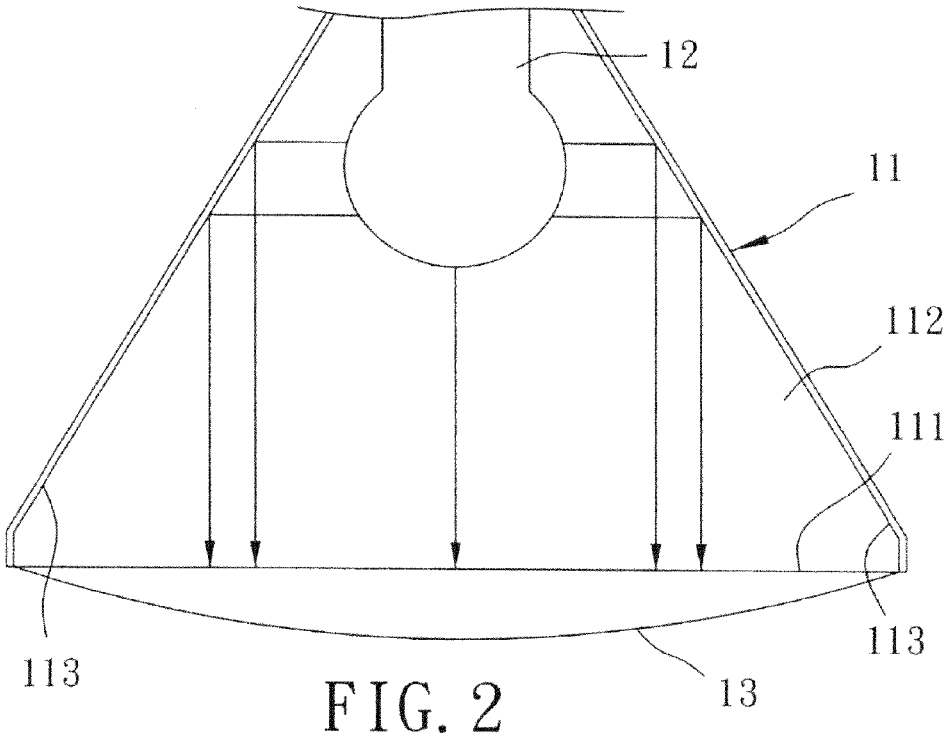
FIG. 2 PRIOR ART
FIG. 2 is a fragmentary schematic view of an interior of the lighting apparatus shown in FIG. 1, illustrating how light emitted by a light source travels in the lighting apparatus.
Figure 3:
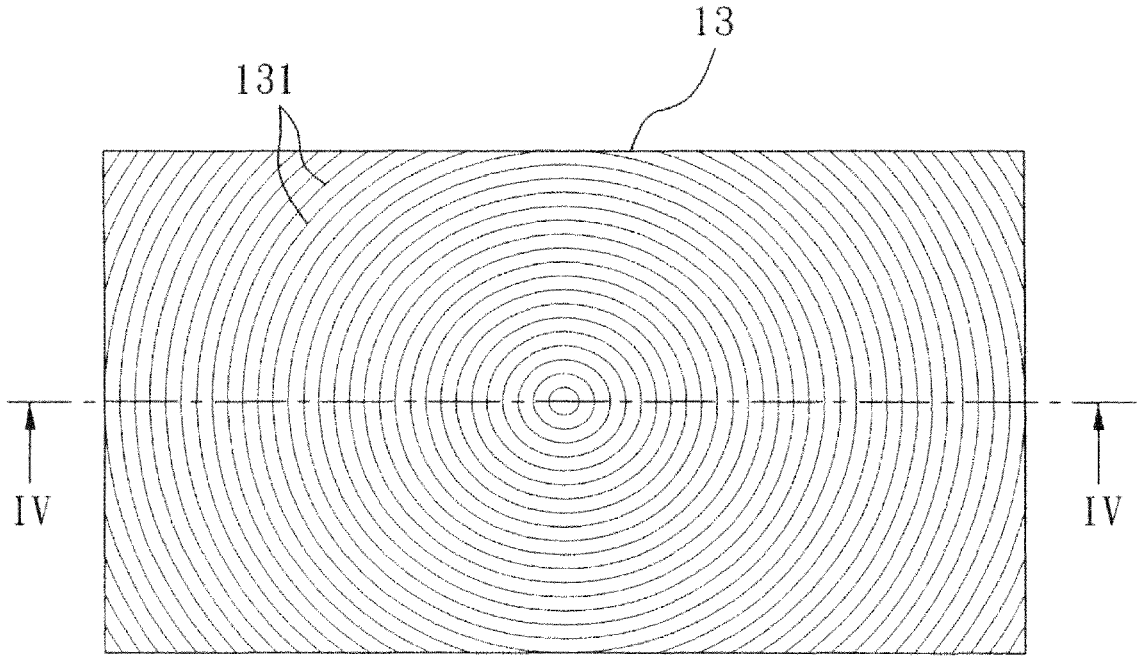
FIG. 3 PRIOR ART
FIG. 3 is a plane view of a lens unit of the lighting device, illustrating concentric annular triangular structures of a Fresnel lens.
Figure 4:
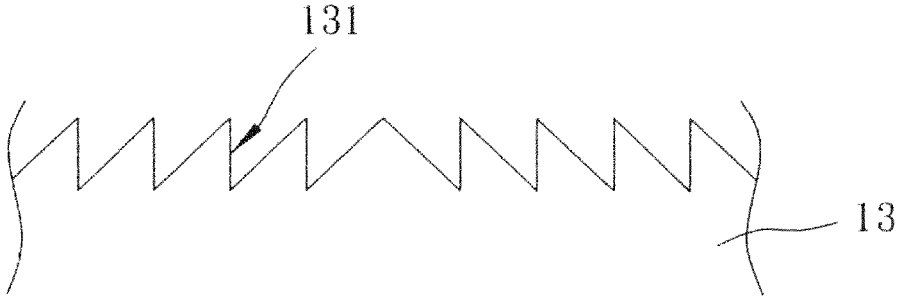
FIG. 4 PRIOR ART
FIG. 4 is a view of the concentric annular triangular structures taken along the line IV-IV of FIG. 3.
Figure 5:
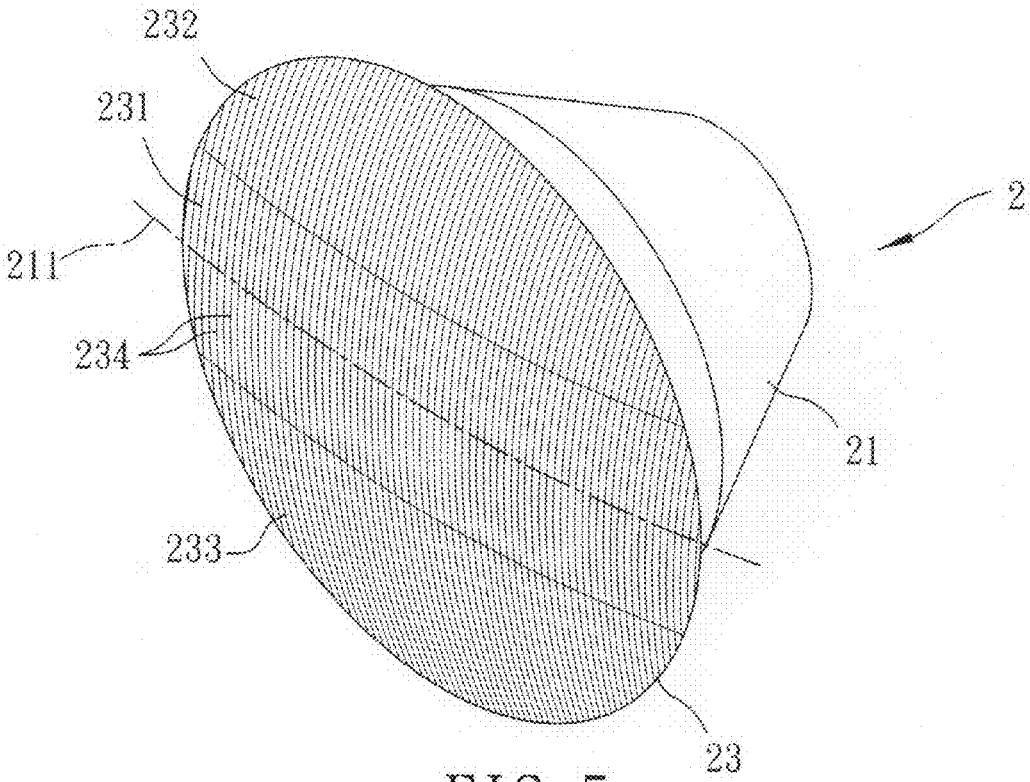
FIG. 5 is a perspective view of the preferred embodiment of a lighting apparatus according to the present invention.
Figure 6:
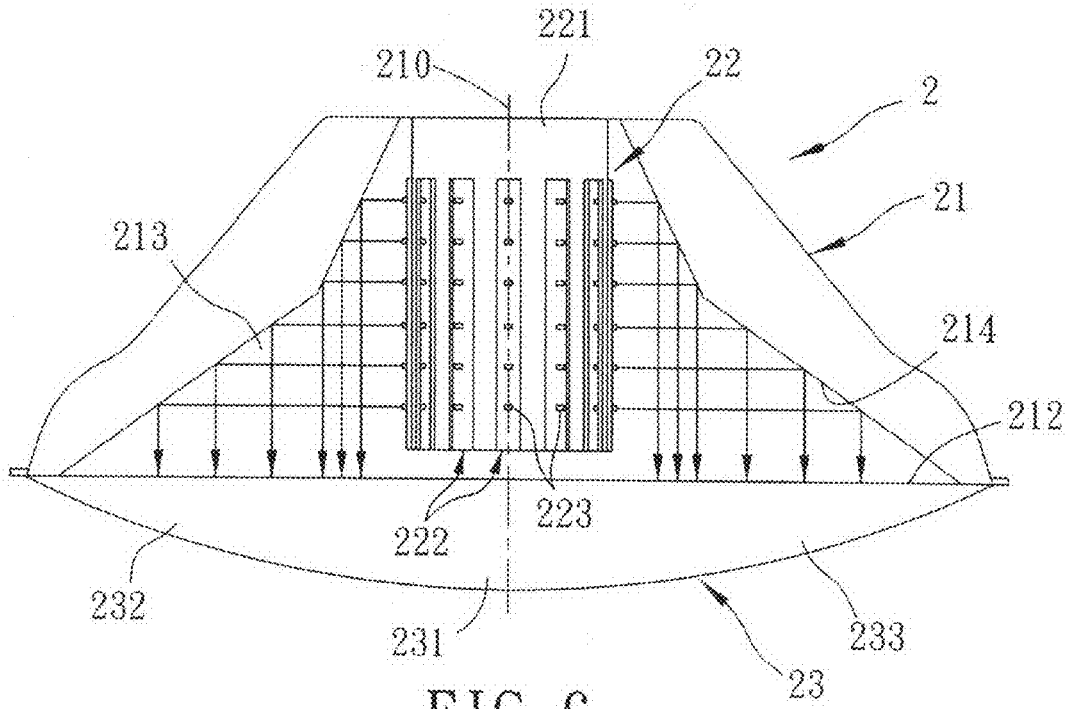
FIG. 6 is schematic view of an interior of the preferred embodiment, illustrating how light emitted by a light source travels in the lighting apparatus.

Referring to FIGS. 5 and 6, the preferred embodiment of a lighting apparatus 2 according to the present invention includes a reflector 21, a light source 22, and a lens unit 23.

The reflector 21 has an open side 212 that defines an axis of symmetry 211, and a reflective surface 214 that extends from a periphery of the open side 212 and that defines a compartment 213. The light source 22 is disposed in the compartment 213 and is operable to emit light toward the reflective surface 214. The reflective surface 214 reflects the light from the light source 22 towards the open side 212. In the preferred embodiment, the open side 212 of the reflector 21 is circular, the reflector 21 is in the form of a hollow conical shape, and the reflective surface 214 is a generally frustoconic surface. The lens unit 23 is disposed to close the open side 212 and permits passage of the light reflected by the reflective surface 214 therethrough. The lens unit 23 includes a central lens portion 231, and first and second side lens portions 232, 233 respectively disposed on two sides of the central lens portion 231 that are on opposite sides of the axis of symmetry 211. The central lens portion 231 and the first and second side lens portions 232, 233 are Fresnel lenses, and are configured in a manner to be described hereinafter to redirect the light passing therethrough to result in rectangularly-distributed illumination outwardly of the lighting apparatus.

The light source 22 includes a columnar base 221 having a surrounding base surface, and a plurality of lamp sets 222 disposed on the surrounding base surface of the columnar base 221. Each of the lamp sets 222 includes at least one light emitting element 223, such as a light emitting diode. In this embodiment, the reflector 21 has a reflector axis 210, and the lamp sets 222 are disposed at angularly spaced apart positions on the surrounding base surface of the columnar base 221 with respect to the reflector axis 210. In addition, each of the lamp sets 222 includes a plurality of the light emitting elements 223 that are disposed at axially spaced apart positions with respect to the reflector axis 210. The columnar base 221 is disposed coaxial to the reflector axis 210, and is made of a material having a high thermal conduction coefficient and a high reflection coefficient. For instance, an aluminum alloy material can be used as the material for making the columnar base 221 for dissipating heat generated by the lamp sets 222 during illumination, and also for reflection of the light incident thereon.

Figure 7:
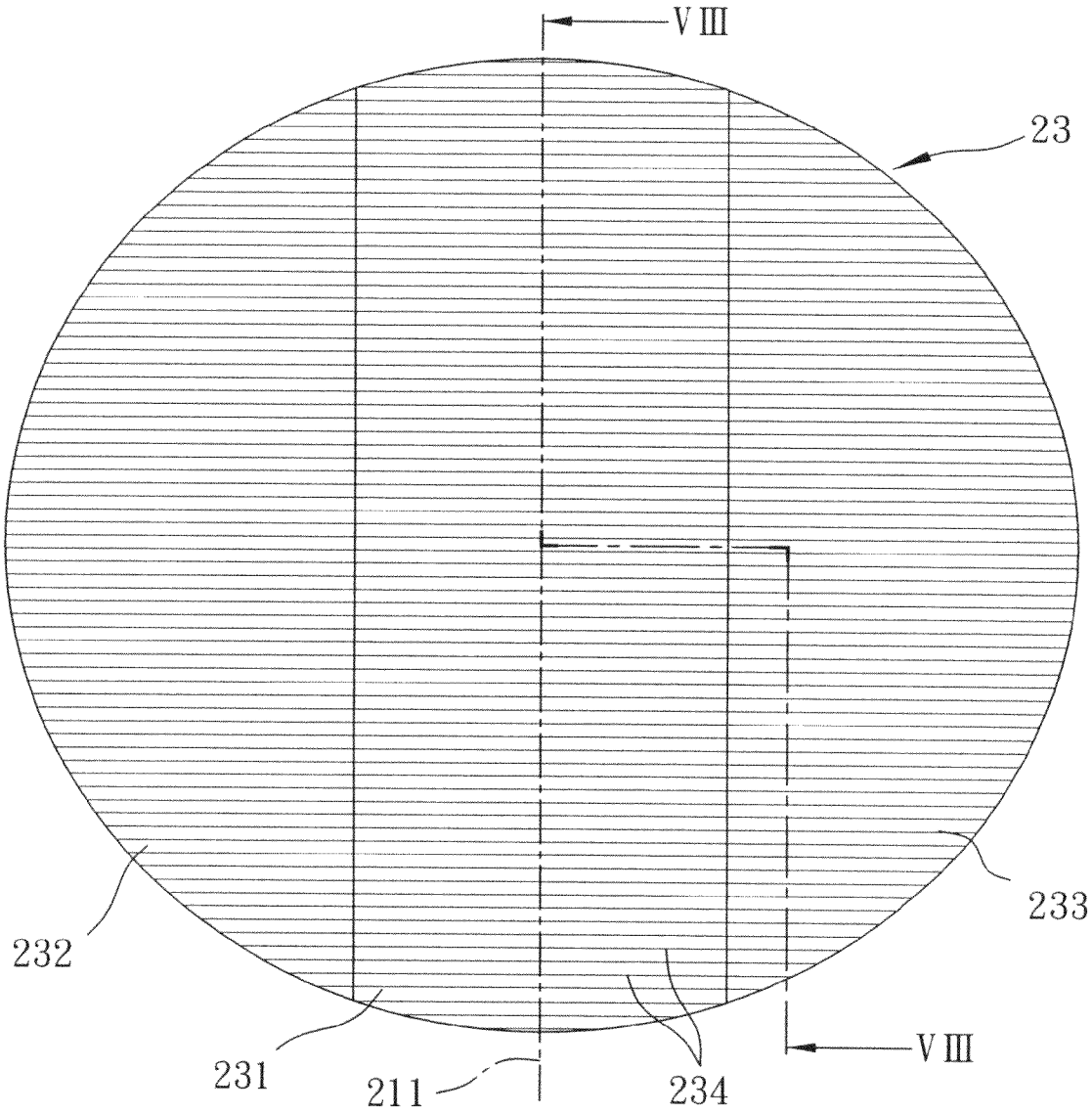
FIG. 7 is a plane view of a lens unit of the preferred embodiment of present invention.
Figure 8:
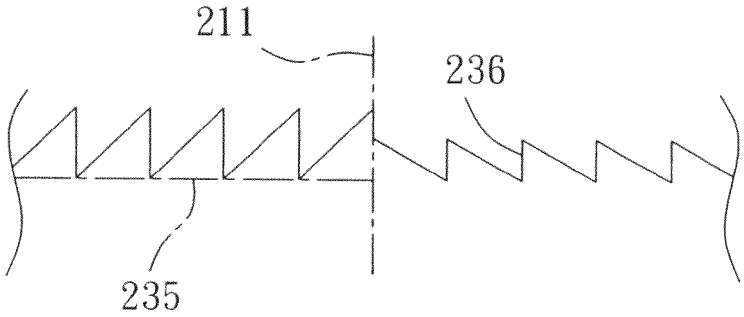
FIG. 8 is a view of triangular structures of the lens unit taken along the line VIII-VIII of FIG. 7.

As illustrated in FIGS. 7 and 8, each of the central lens portion 231 and the first and second side lens portions 232, 233 is formed with a plurality elongate triangular structures 234 that protrude in a direction away from the compartment 213 and that are generally perpendicular to the axis of symmetry 211. Moreover, each of the triangular structures 234 has a cross-section in a shape of a right triangle that has a ratio of height to base width ranging from 0.2 to 2. In particular, the ratio of height 236 to base width 235 of the cross-section of each of the triangular structures 234 of the central lens portion 231 is smaller than the ratio of height 236 to base width 235 of the cross-section of each of the triangular structures 234 of the first and second side lens portions 232, 233.

Figure 9:
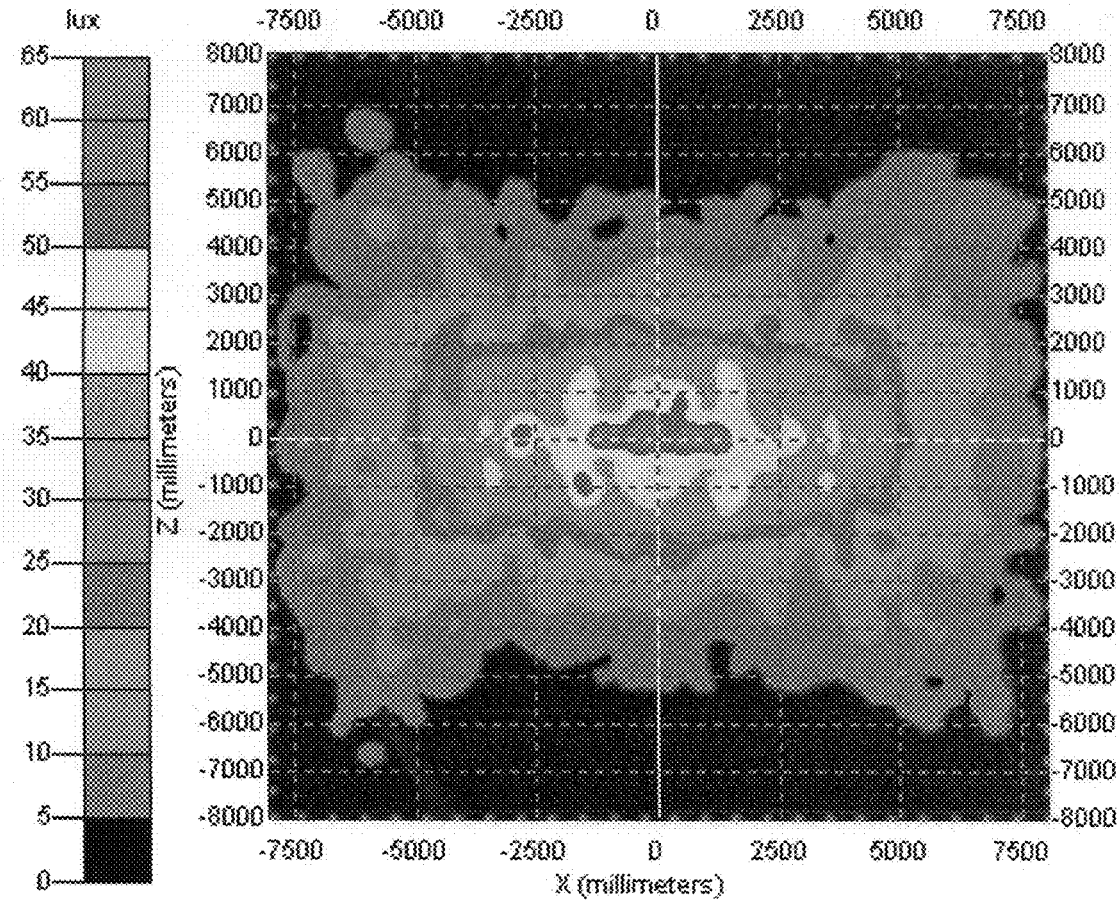
FIG. 9 shows a plot of the illumination intensity obtained for the lighting apparatus and measured at a reference plane.

FIG. 9 illustrates a plot of the illumination intensity obtained for the lighting apparatus 2 and measured at a reference plane. In operation, the reflecting surface 214 reflects light emitted by the light source 22 toward the opening 212 to thereby cast circularly-distributed illumination, which undergoes refraction or redirection while passing through the lens unit 23 to result in rectangularly-distributed illumination outwardly of the lighting apparatus 2.

Figure 10:
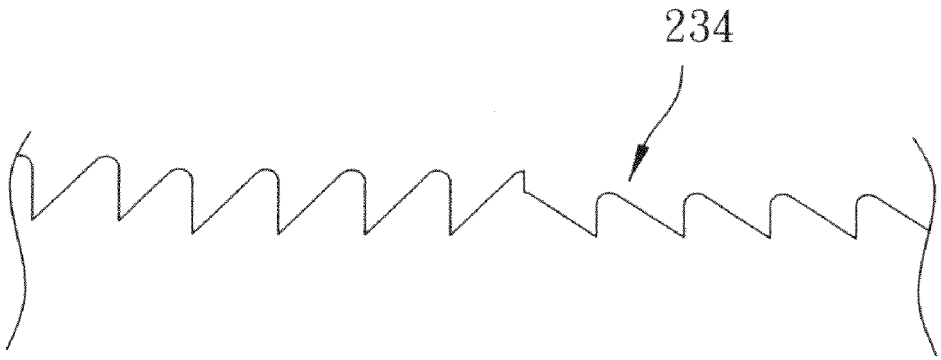
FIG. 10 is a view similar to FIG. 8 but illustrating the triangular structures formed with rounded corners.
Figure 11:
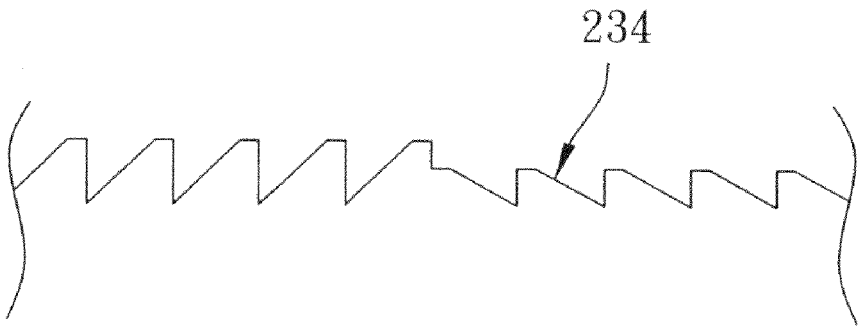
FIG. 11 is a view similar to FIG. 8 but illustrating the triangular structures formed with flattened tips.

Reference is now made to FIGS. 10 and 11. In view of manufacturing considerations, the triangular structures 234 of the central lens portion 231 and the first and second side lens portions 232, 233 can be alternatively formed to have rounded corners (see FIG. 10) or flattened tips (see FIG. 11) without affecting the rectangularly-distributed illumination outwardly of the lighting apparatus 2.

The meritorious advantages that can be achieved using the lighting apparatus 2 of the present invention are as follows:

Unlike the conventional lighting device 1, which relies on the four-sided reflector body 11 to cast rectangularly-distributed illumination, the lighting apparatus 2 of this invention incorporates a lens unit 23 that redirects circularly-distributed illumination into rectangularly-distributed illumination outwardly of the lighting apparatus 2.

As a result, loss of the light energy inside the reflector 21 can be minimized and less power is consumed as compared to the conventional lighting device 1.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A lighting apparatus comprising:

a reflector having an open side that defines an axis of symmetry, and a reflective surface that extends from a periphery of said open side and that defines a compartment;

a light source disposed in said compartment and operable to emit light toward said reflective surface, said reflective surface reflecting the light from said light source towards said open side; and a lens unit that is disposed to close said open side and that permits passage of the light reflected by said reflective surface therethrough, said lens unit including a central lens portion, and first and second side lens portions respectively disposed on two sides of said central lens portion that are on opposite sides of said axis of symmetry, wherein said central lens portion and said first and second side lens portions are Fresnel lenses, configured to redirect the reflected light from the reflective surface of the reflector, and wherein the lighting apparatus provides rectangularly-distributed illumination outwardly.

2. The lighting apparatus as claimed in claim 1, wherein each of said central lens portion and said first and second side lens portions is formed with a plurality elongate triangular structures that protrude in a direction away from said compartment and that are generally perpendicular to said axis of symmetry.

3. The lighting apparatus as claimed in claim 2, wherein each of said triangular structures has a cross-section in a shape of a right triangle that has a ratio of height to base width ranging from 0.2 to 2.

4. The lighting apparatus as claimed in claim 3, wherein the ratio of height to base width of the cross-section of each of said triangular structures of said central lens portion is smaller than the ratio of height to base width of the cross-section of each of said triangular structures of said first and second side lens portions.

5. The lighting apparatus as claimed in claim 1, wherein said light source includes a columnar base having a surrounding base surface, and a plurality of lamp sets disposed on said surrounding base surface of said columnar base, each of said lamp sets including at least one light emitting element.

6. The lighting apparatus as claimed in claim 5, wherein said light emitting element is a light emitting diode.

7. The lighting apparatus as claimed in claim 5, wherein said reflector has a reflector axis, and said lamp sets are disposed at angularly spaced apart positions on said surrounding base surface of said columnar base with respect to said reflector axis.

8. The lighting apparatus as claim in claim 7, wherein each of said lamp sets includes a plurality of said light emitting elements that are disposed at axially spaced apart positions with respect to said reflector axis.

9. The lighting apparatus as claimed in claim 8, wherein said columnar base is disposed coaxial to said reflector axis.

10. The lighting apparatus as claimed in claim 5, wherein said columnar base is made of a material having a high thermal conduction coefficient and a g\hith reflection coefficient.

11. The lighting apparatus as claimed in claim 1, wherein said open side of said reflector is circular, and said reflective surface is a generally frustoconic surface.

12. The lighting apparatus as in claim 1, wherein the light source is disposed in the compartment with no intervening refracting surface between said light source and said reflective surface.

* * * * *